United States Patent [19]

Thomas, Jr.

[11] 4,397,324

[45] Aug. 9, 1983

[54] MANICURING DEVICE

[76] Inventor: Robert W. Thomas, Jr., 100 E. Kentuckey Ave., Apt. K-2, Deland, Fla. 32720

[21] Appl. No.: 314,026

[22] Filed: Oct. 22, 1981

[51] Int. Cl.[3] ..... A45D 29/18

[52] U.S. Cl. ..... 132/73.5; 401/121

[58] Field of Search ..... 132/75, 73.5; 15/210; 401/121-122, 124

[56] References Cited

U.S. PATENT DOCUMENTS 2,703,422 3/1955 Roosa ..... 132/75

3,369,266 2/1968 Willson ..... 132/75 X 4,282,891 8/1981 Duceppe ..... 132/75

*Primary Examiner*—G. E. McNeill

*Attorney, Agent, or Firm*—Henderson & Sturm

[57] ABSTRACT

This invention relates to manicuring devices in general and more specifically to a receptacle for nail polish remover, having a brush member disposed within the receptacle in a unique manner, and a novel resilient closure member which prevents evaporation of the contents of the receptacle and provides an abrasive surface for a finger entering the receptacle, and a wiping surface for a finger being withdrawn from the receptacle.

8 Claims, 6 Drawing Figures

MANICURING DEVICE

BACKGROUND OF THE INVENTION

The prior art is replete with patents directed to nail polish removal receptacles, which support or suspend a brush element to aid in the removal of hardened nail polish from a persons fingernails after immersion into nail polish remover contained within the receptacle.

Reference to the aforementioned prior art devices may be had by a review of U.S. Pat. No's; 3,369,266; 2,629,124; 2,703,422; 4,022,228 and 3,316,922.

While the above cited references perform adequately for their intended purpose, they all are deficient in several notable respects. First of all, nail polish remover is volatile and has a rapid rate of evaporation, and all of the prior art devices provide an inordinately large opening to accommodate the users fingers, which results in excess evaporation of the receptacle contents. Secondly, none of the cited patents compensate for the liquid which is removed when the users fingers are withdrawn from the receptacle, which is not an insignificant amount. In addition, prior patented devices have taken great pains to suspend the brush element within the receptacle, while overlooking the simplest method of accomplishing this task. Finally, while most nail polish removal solvents work very well to dissolve the hardened nail polish; they would be even more efficient if the hardened surface of the polish were abraded prior to, or simultaneously with, the insertion of the fingers into the receptacle.

SUMMARY OF THE INVENTION

An object of the present invention is the provision of a nail polish remover receptacle having a unique closure element, which virtually eliminates evaporation losses of the receptacles contents during use, and therefore prolongs the useful life of the liquid contained therein.

Another object of the instant invention is the provision of a nail polish remover receptacle having a resilient closure, which abrades the nail polish surface as the finger is inserted into the receptacle, and which wipes the liquid from the users fingers as it is withdrawn.

Still another object of the present invention is the provision of a receptacle which has a wide mouth to accommodate and facilitate the insertion of the brush element within the receptacle prior to the closure element being attached.

Yet another object of the present invention is the provision of a simple but improved brush element and support which is configured to be simply and easily inserted into the receptacles interior.

A further object of the instant invention is the provision of an improved nail polish removal receptacle, which is spill-proof and overcomes all of the deficiencies of the prior art devices, and which further provides solutions to problems which they failed to address or recognize.

These and other objects, advantages and novel features of the present invention will become apparent when considered with the teachings contained in the detailed disclosure to follow, along with the accompanying drawings.

DETAILED DESCRIPTION OF THE PREFERRED EMBODIMENT

Figure 1:
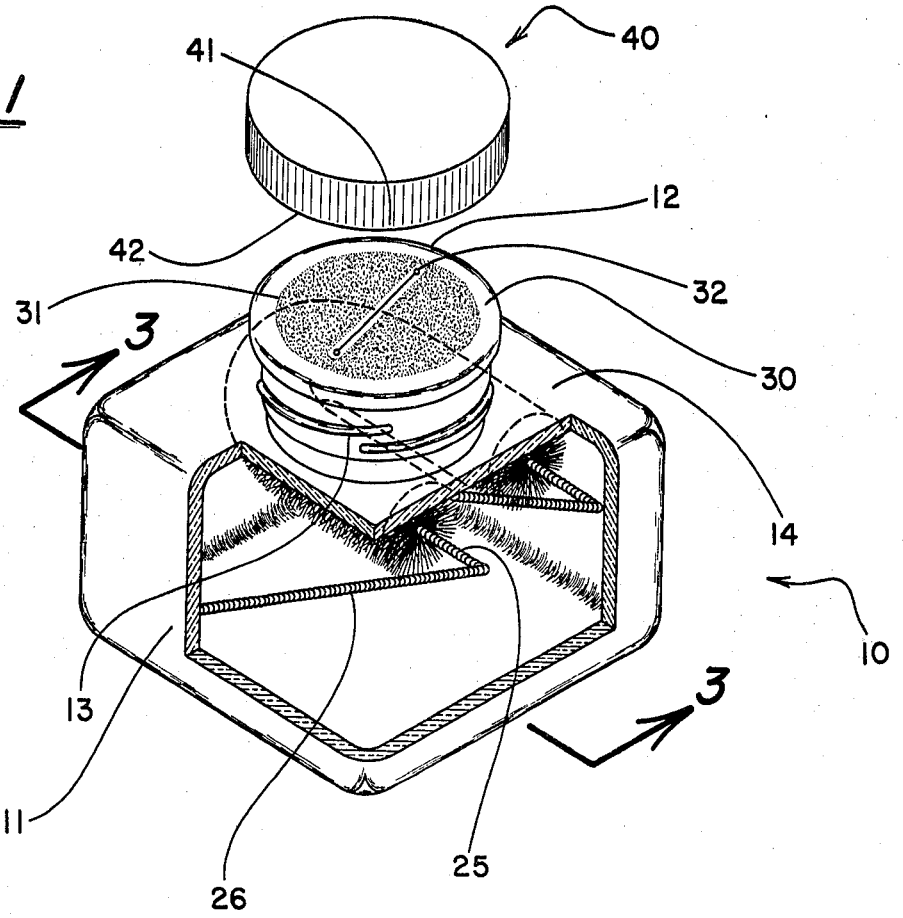
FIG. 1, is a perspective view, partially broken away showing the nail polish remover receptacle of the instant invention in use.

As can be seen by reference to FIG. 1, the container per se is designated generally as 10, and comprises a generally rectangular glass receptacle 11, having a relatively large circular opening 12, formed by a threaded neck portion 13, which projects from the shoulders 14 of the receptacle.

The receptacle 10 further contains a brush element 20, which is provided with support means 25, in the form of wire legs 26, which support the brush element 20, proximate the terminus of the circular opening 12 within the receptacle interior 15.

Referring to FIGS. 1–4, it can be seen that the opening 12, of the receptacle 10 is further provided with primary 30 and secondary 40 closure elements which are intended to retain the nail polish remover liquid 50 and vapor 51 within the interior 15 of the receptacle. The primary closure element 30, comprises a resilient diaphram 31, having at least one elongated aperture or slit 32 disposed at its midpoint, and extending through its thickness, to form a virtually spill proof barrier which will permit a finger to be inserted and withdrawn from the interior of the receptacle.

Figure 2:
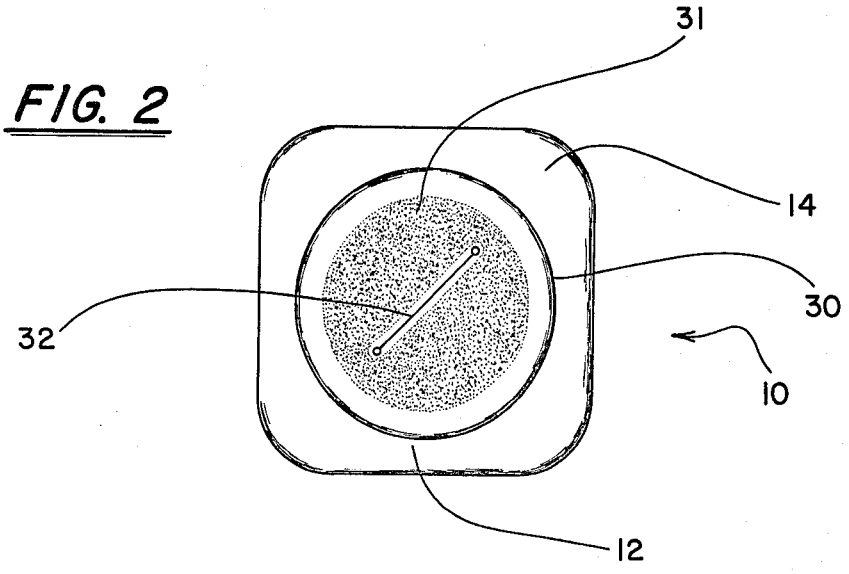
FIG. 2, is a top plan view of the improved closure member which is incorporated into the receptacle.
Figure 3:
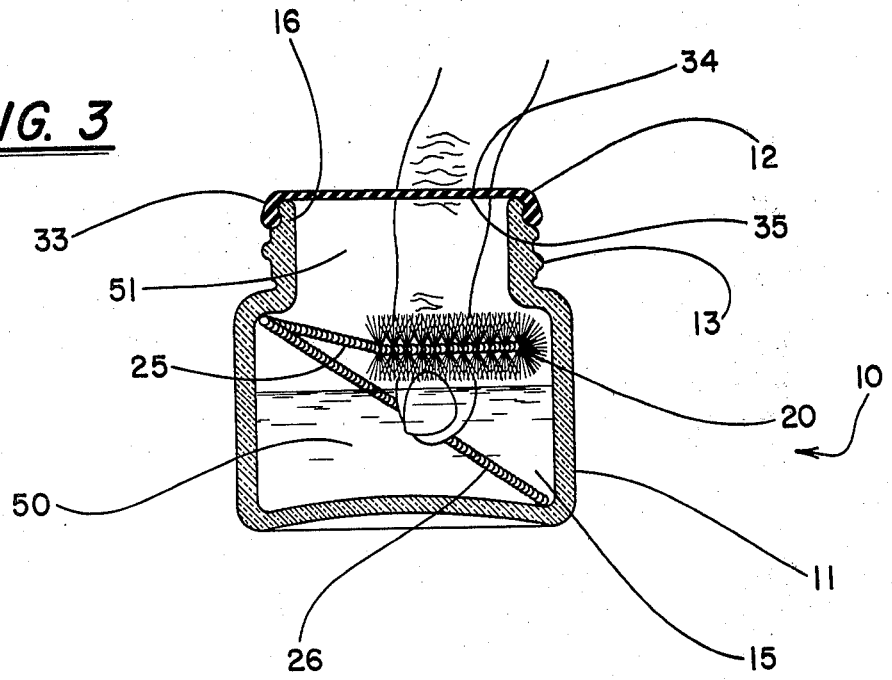
FIG. 3, is a cross-sectional view taken thru line 3—3 of FIG. 1, of the receptacle and primary closure element as they would appear as a finger is inserted into the receptacle.

In one embodiment shown in FIGS. 1 thru 3, the primary closure 30, is provided with a beaded periphery 33, which is dimensioned to be received in an appropriate configured recess 16, on the exterior of the threaded neck portion 13 of the receptacle 10. In this embodiment, the resilient diaphram 30 cooperates with the secondary closure element 40 to insure that a vapor and liquid tight seal is established between the receptacle interior and exterior, by the compression of a portion of the resilient primary closure against the threaded neck portion.

Figure 4:
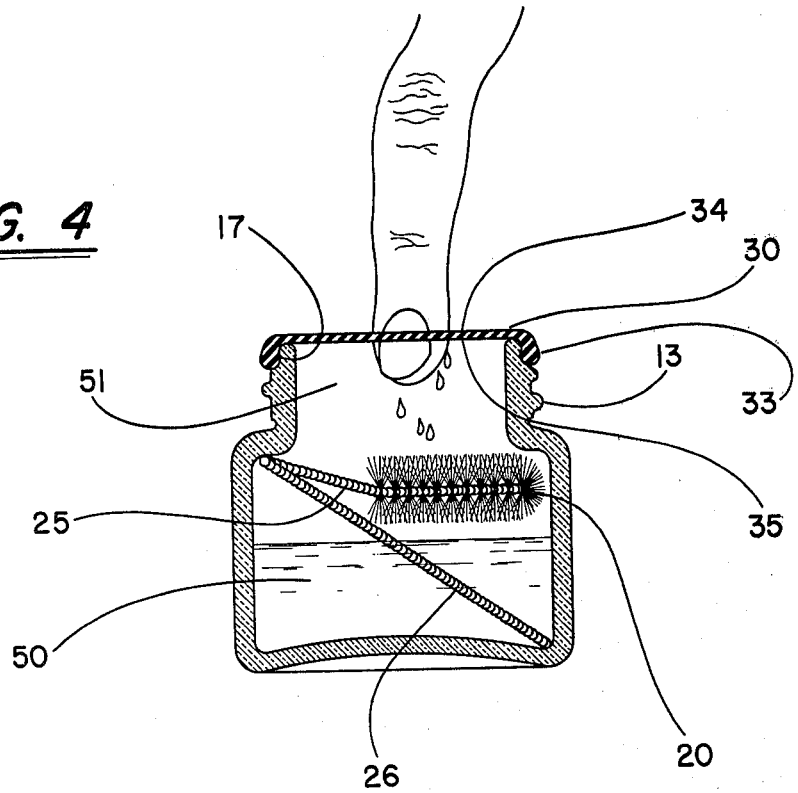
FIG. 4, is a cross-sectional view similar to FIG. 3, but showing the receptacle and closure as a finger is withdrawn from the receptacle.

In the other embodiment illustrated in FIG. 4, the primary closure 30 is also provided with a beaded periphery 33, which is dimensioned to be received in an appropriately configured recess 17 on the interior of the threaded neck portion 13. It should be appreciated that in this embodiment, since the primary closure 30 is disposed on the interior of the threaded neck portion 13, and the secondary closure is disposed on the exterior of the threaded neck portion, that there is no enhanced sealing by cooperation or interaction of the primary and secondary closures.

The secondary closure 40 in both embodiments is in the form of a cap member 41 having interior threads 42, which cooperate with the threaded neck portion of the receptacle in a well recognized manner.

As has been stated supra, the primary closure 30 is resilient in nature, but it must also be fabricated from a material, which not only possesses resiliency, but is further virtually impervious to the deleterious effects of the nail polish remover in both the liquid and vapor phase. Once a material (e.g. butyl rubber) has been chosen, which has the requisite properties and physical characteristics sought, it should be fairly obvious that the resilient nature and configuration of the primary closure in the embodiment illustrated in FIGS. 1 thru 3, creates a resilient seal or barrier between the secondary closure and the receptacle, by the frictional engagement of the aforementioned elements with the primary closure.

As can best be seen in FIGS. 3 and 4, when a finger 1 is inserted through the diaphragm aperture 32, the exterior surface 34 of the diaphragm adjacent the slit is flexed downwardly and inwardly by the motion of the finger, and this surface is in frictional contact with the periphery of the finger. When the finger is withdrawn, the interior surface 35 of the diaphragm is flexed upwardly and outwardly, and this surface is in frictional wiping contact with the periphery of the finger.

Figure 5:
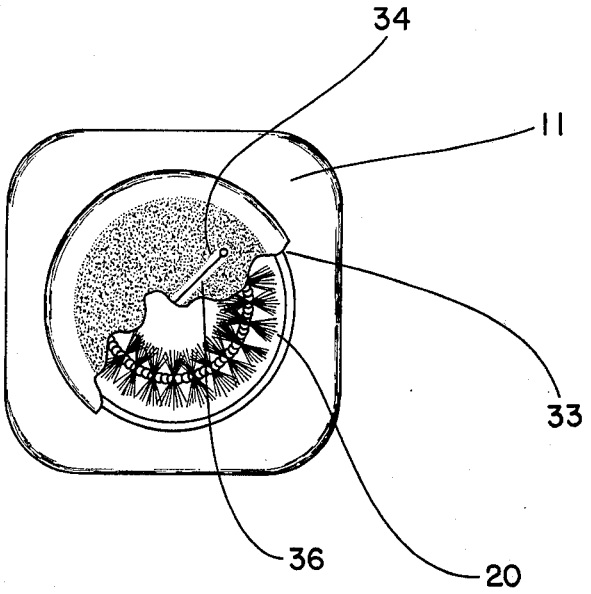
FIG. 5, is a detail view of the top of the resilient closure showing the disposition of the abrasive material adjacent the aperture.

Referring now to FIG. 5, it can be seen that the exterior surface 34 of the diaphragm adjacent the aperture is provided with abrasive particles 36. The abrasive particles 36 may be impregnated into the diaphragm, or they may be affixed to the exterior surface by adhesives or other suitable securing means. The purpose of the abrasive particles 36 is to abrade or fracture the surface, of the hardened polish on the fingernail, as the finger is inserted into the receptacle. This initial fracturing exposes more polish surface area to the nail polish solvent and decreases the time necessary to remove the polish from the nail surface.

Fabricating the primary closure in accordance with this invention not only enhances the efficiency of the solvent, but extends the useful life of solvent in that the resilient aperture constantly engages the periphery of the finger while it is within the receptacle, by forming a seal which inhibits solvent vapor from leaving the interior of the receptacle, and also substantially reduces the amount of liquid which would be transformed into vapor in the absence of such a seal. In addition, when the finger is withdrawn from the receptacle, the wiping action of the diaphragm retains a large portion of the liquid solvent which would normally be removed at that juncture.

Figure 6:
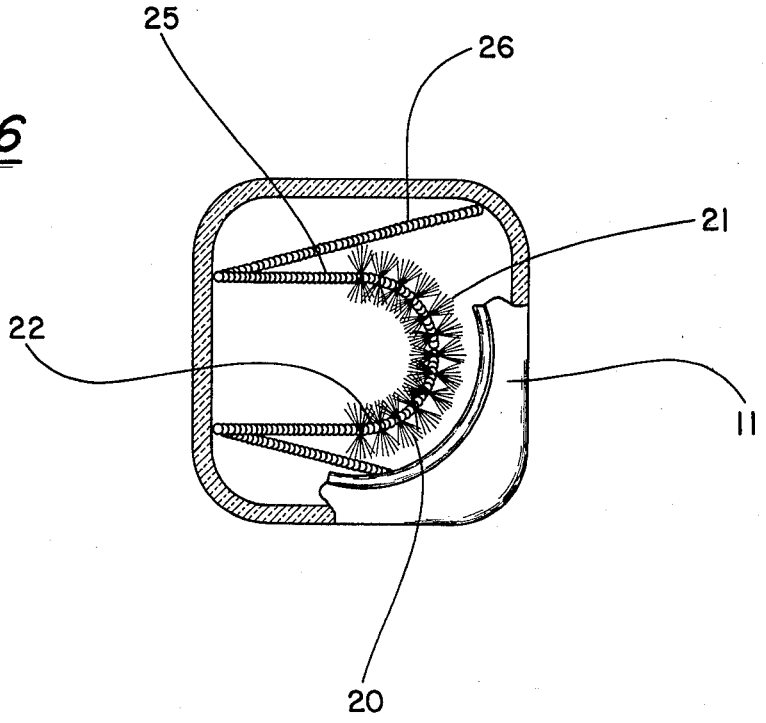
FIG. 6, is a cross-sectional view of the receptacle showing how the brush element is inserted into the receptacle prior to the primary closure being attached.

FIG. 6, illustrates another novel feature found in the present invention. The brush element 20 has the same basic construction and function as those brush elements disclosed by the prior art i.e. bristles 21 wound around a relatively rigid U-shaped substrate 22 which terminates in a support member 25 in the form of wire legs 26. However, the novelty resides in the dimensioning of the receptacle interior 15 and the circular opening 12, particularly with respect to the dimension of the support legs 26 and the brush element 20, and also the disposition of the last named elements relative to one another.

The support legs 26 are dimensioned to extend almost completely across the diagonal interior dimension of the receptacle. The actual dimension however is somewhat less than the diagonal distance, since the legs are intended to be inserted through the large circular opening in the receptacle, and the sides of the aperture must be taken into consideration to avoid unnecessary flexure of the support legs. Given the fact that the bristles 21 extend a significant distance beyond the substrate 22, it is possible to dimension the support legs, substrate and bristle length so that the only element which would be deformed when the brush is inserted into the receptacle will be the bristles which contact the sides of the aperture. As can be seen in FIG. 6, the support legs are inserted vertically into the aperture, and prior to, or after they have contacted the base of the receptacle, they are guided into one of the junctures between the base and one of the vertical walls. The brush is then pivoted about this juncture to bring the top of the support legs into contact with a vertical wall diametrically opposite the first named wall. At this point the bristles and associated substrate are pivoted about the support legs to bring the brush into position, within the receptacle interior, and beneath the aperture. During this final movement, the bristles are deformed and collapsed by the sides of the aperture, and upon entering the receptacle interior, these bristles will flex back to their normal position to engage the underside of the receptacle top, and retain the brush in the desired position.

It should be appreciated, that the adoption of the aforementioned configuration and relative dimensions, will produce a spill-proof device which is very simple to manufacture and assemble, and which therefore can be produced at a very low cost and these savings can be ultimately passed on to the consumer.

Having thereby described the subject matter of this invention, it should be obvious, that in light of the teachings contained herein the invention may be practised other than as specifically disclosed, and should be limited only by the breadth and scope of the appended claims.

What I claim is:

1. An improved container for liquid nail polish remover comprising:

a generally rectangular receptacle having a large circular opening formed by a raised threaded neck portion, a brush element having support means disposed in the interior of said receptacle, a resilient apertured primary closure means secured to said raised neck portion; wherein, the primary closure comprises a resilient diaphragm having an elongated slit disposed at its midpoint, and a beaded periphery which is dimensioned to be received within a recess in said raised neck portion; and the resilient diaphragm is further provided with abrasive particles disposed on its exterior surface adjacent the elongated slit.

2. An improved container as in claim 1, further comprising:

a secondary closure in the form of a threaded cap which cooperates with said threaded neck portion to seal the container.

3. An improved container as in claim 2: wherein, the recess in said raised neck portion is formed on the exterior surface.

4. An improved container as in claim 2; wherein, the recess in said raised neck portion is formed on the interior surface.

5. An improved container as in claim 3; wherein, the secondary closure compresses a portion of the resilient primary closure against the threaded neck portion to provide a vapor and liquid tight seal.

6. An improved container as in claim 5; wherein, said brush element comprises a generally U-shaped substrate supported by wire legs and having a plurality of bristles disposed thereon.

7. An improved container as in claim 6; wherein, the receptacle opening and interior are dimensioned to receive the brush element within the interior, with only the bristles on the brush element being deformed, when the brush element is inserted into the receptacle.

8. An improved container as in claim 2; wherein, said primary closure forms a virtually spill-proof barrier for a liquid within the container.

* * * * *